United States Patent [19]

Drogo

[11] Patent Number: 4,619,491

[45] Date of Patent: Oct. 28, 1986

[54] ELECTRIC CONNECTOR WITH PULL-OUT PLUG

[76] Inventor: Pierre L. M. Drogo, Dampierre en Burly by Ouzouer sur Loire (Loiret), France

[21] Appl. No.: 675,764

[22] Filed: Nov. 28, 1984

[30] Foreign Application Priority Data

Nov. 29, 1983 [FR] France ..... 83 19049

[51] Int. Cl.[4] ..... H01R 13/62

[52] U.S. Cl. ..... 339/45 M; 339/46; 339/75 M; 339/90 R

[58] Field of Search ..... 339/45, 46, 143 R, 89 R, 339/89 M, 90 R, 186 M, 91 B, 75 RM, 255 R, 256 R, 258 R

[56] References Cited

U.S. PATENT DOCUMENTS

| | | | |
|---|---|---|---|
| 3,152,850 | 10/1964 | Nava et al. | 339/89 M |
| 3,466,590 | 9/1969 | Sylvester | 339/186 M |
| 3,594,694 | 7/1971 | Clark | 339/45 M |
| 3,678,439 | 7/1972 | Vetter | 339/46 |
| 3,680,033 | 7/1972 | Kawai | 339/46 |
| 4,390,222 | 6/1983 | Carter | 339/45 M |

*Primary Examiner*—Gil Weidenfeld
*Assistant Examiner*—David L. Pirlot
*Attorney, Agent, or Firm*—Kinzer, Plyer, Dorn & McEachran

[57] ABSTRACT

Connector characterized in that the base comprises a locking device (15) designed to retain the edge of the bolt of the plug, this locking device (15) withdrawing under the action of an axial opening force of the connector, which force is transmitted to the bolt and exceeds a predetermined threshold.

8 Claims, 17 Drawing Figures

ELECTRIC CONNECTOR WITH PULL-OUT PLUG

Figure 1:
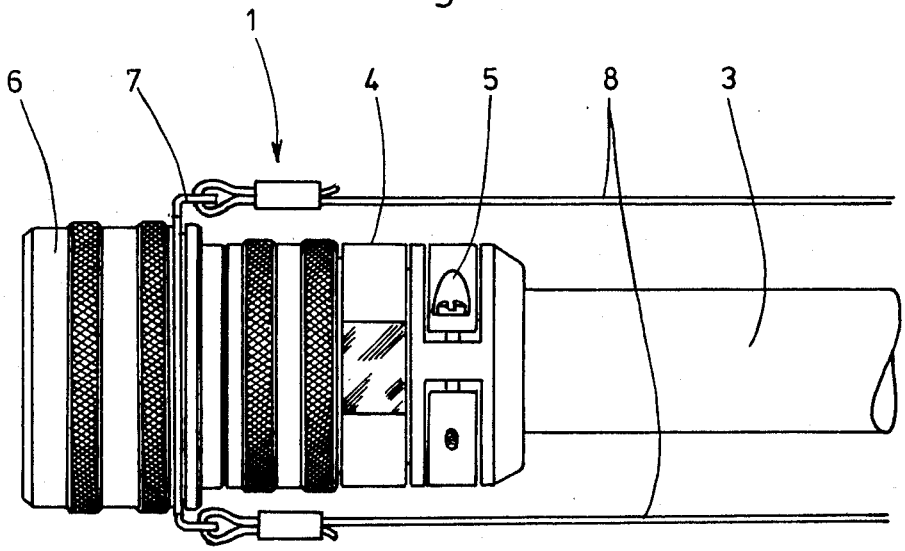

The present invention relates to an electric connector composed of a plug and a base which can be connected together in the axial direction under the action of a bolt provided on the plug, the plug and the base having a body receiving internally an insert of insulating material provided with male and female pins for electrical connection, the bolt being mounted on the body of the plug and means being provided for its controlled relative displacement in the axial direction and in rotation, this bolt also having means for its connection to the base such that the bolt is capable of relative rotation on the body of the base when in the connected position, the plug and the base having complementary guide elements enabling them to be assembled coaxially in only one angular position.

Various types of connectors have already been disclosed, in particular in French Pat. Nos. 83 02 696 and 83 11 513. These two Patents relate to connectors in which the plug is locked to the base by a partial rotation of the bolt, for example through 100°.

Although this solution is particularly interesting in the technical field, in certain cases it is necessary to be able to disconnect the plug forcibly from its base by exerting a pull either on the bolt or on the cable to which the plug is connected.

Such forceful disconnection is not possible in the case of a connector composed of a plug and base as described in the above mentioned Patents and no other solutions providing such possibilities exist.

A simplistic solution would consist of connecting the plug and base by a simple movement of translation. Such a solution is illusory, however, since a connector is composed of male part and a female part each having electric connecting members for connecting dozens of conductors or even as many as one hundred or more.

Given the miniaturisation of electric connecting members in most connectors, it would not be possible to connect the plug and base together simply by pushing the plug into the base. The connection must always be made by a movement of presentation, using corresponding guiding and correcting elements provided both on the base and on the plug to ensure correct axial alignment of the plug with the base, and this gross movement of translation must then be completed by a precise movement of translation controlled by the bolt. Moreover, the plug must remain solidly connected to the base.

For certain purposes, it would be very useful to be able to disconnect the plug of a connector from its base by exerting a certain amount of pull without having to unlock the plug by an operation which is the reverse of the locking procedure.

For this purpose, the present invention proposes to provide a connector having all the qualitites of the plug-base connection of conventional connectors but in addition enabling the plug to be disconnected from the base by a pull exerted on the bolt, either by way of a cord or by way of the electric cable attached to the connector.

The invention thus relates to an electric connector characterised in that the guide elements and the elements for mechanically holding the plug to its base can withdraw under the action of an axially directed opening force exerted on the connector, which force is transmitted to the bolt and exceeds a predetermined threshold.

Thus traction exerted on the bolt either by way of cords or the like or by way of the cable and the body of the plug is capable of disconnecting the plug by a sudden and rapid movement without the bolt having to be subjected to a movement of rotation and translation in the reverse direction to that used for locking. Such a connector is particularly advantageous, in particular in that the plug can be disconnected from the base automatically and rapidly without human intervention.

According to another feature of the invention, the locking device is formed by a collar seated in a recess in the body of the base. This collar has elastic tongues cut out of its body, each tongue carrying at least one element (lug) capable of cooperating in a locking action with the corresponding edge of the bolt.

According to another characteristic of the invention, each tongue is for at least the most part of its length cut out of the collar in such a manner as to leave on one hand a connecting band preserving the continuity of the collar and on the other hand a supporting band, these two bands serving to support the collar against corresponding shoulders bordering the sides of the recess into which the tongue can be pushed.

According to another characteristic of the invention, the lug has an axial width greater than the width of the tongue and is associated with a corresponding seating into which it can withdraw.

According to another characteristic of the invention, each tongue has a control lug and a retaining lug, the control lug ensuring that the bolt will be held in position as long as the force exerted on the bolt in the direction of pulling it away is below a given threshold force while the retaining lug provided between that end of the tongue which carries the control lug and the base of the tongue cooperates with a part of the plug to ensure that it will be held in position but when the threshold force required to pull the connector apart is exceeded, the effort exerted on the bolt causes the edge of the bolt to move over the control lug, pushing it inwards and causing the retaining lug to be withdrawn, thereby releasing the plug.

According to another characteristic of the invention, one part of the plug consists of a sleeve having at least one seating conforming to the retaining lugs and designed to cooperate with these lugs.

The connector according to the invention may be regarded in general terms as a particularly simple and reliable construction. It has the advantage of embodying numerous variations which may all be connected to the same base. Thus the base of the connector may receive a conventional plug, in particular a plug according to French Pat Nos. 83 02 696 and 83 11 513. The same base may also receive a plug which can be disconnected from the base by means of cords connected to the bolt, or it may receive a plug designed to be disconnected by traction exerted directly on the cable and thereby on the plug and hence on the bolt.

Figure 3:
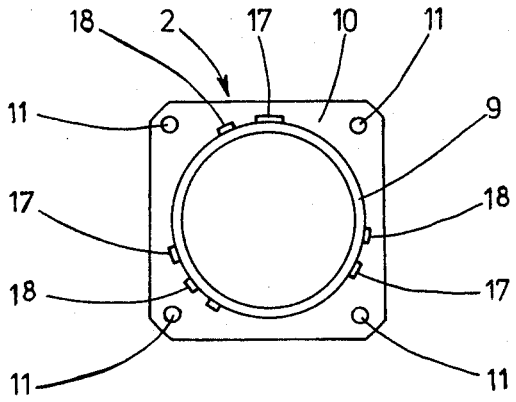
Figure 2:
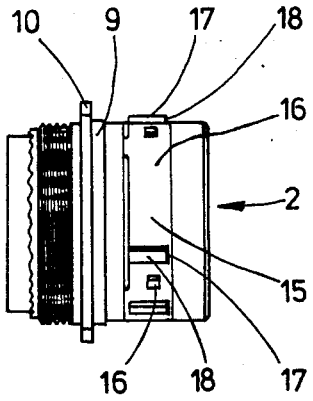
Figure 4:
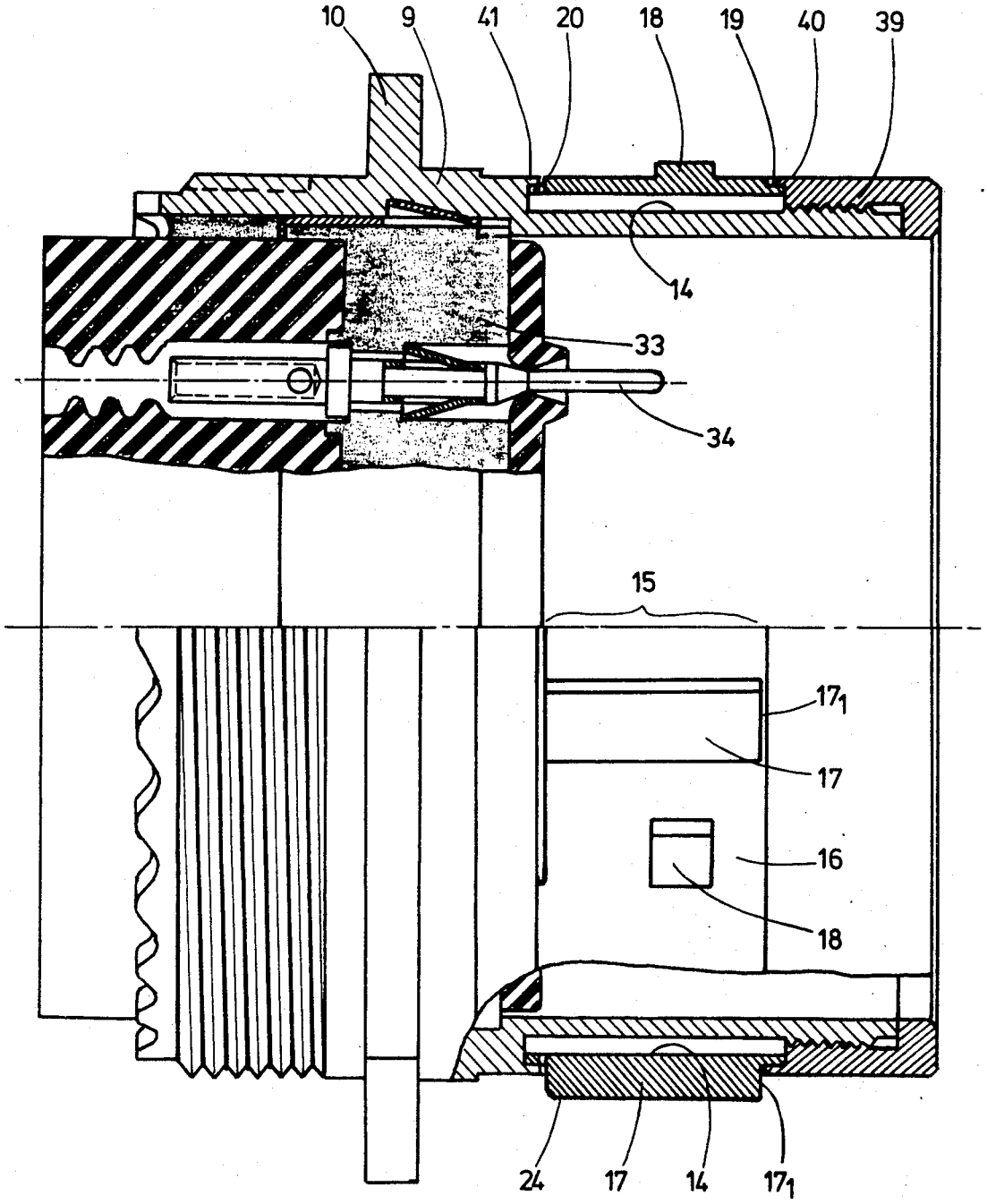
Figure 6:
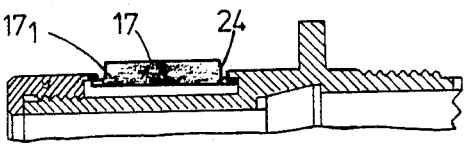
Figure 14:
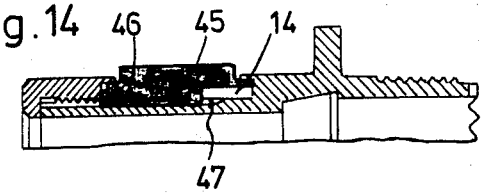
Figure 7:
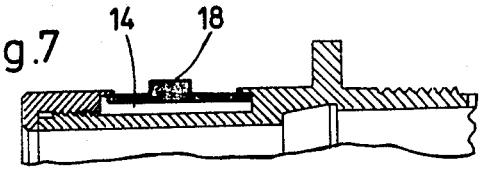
Figure 5:
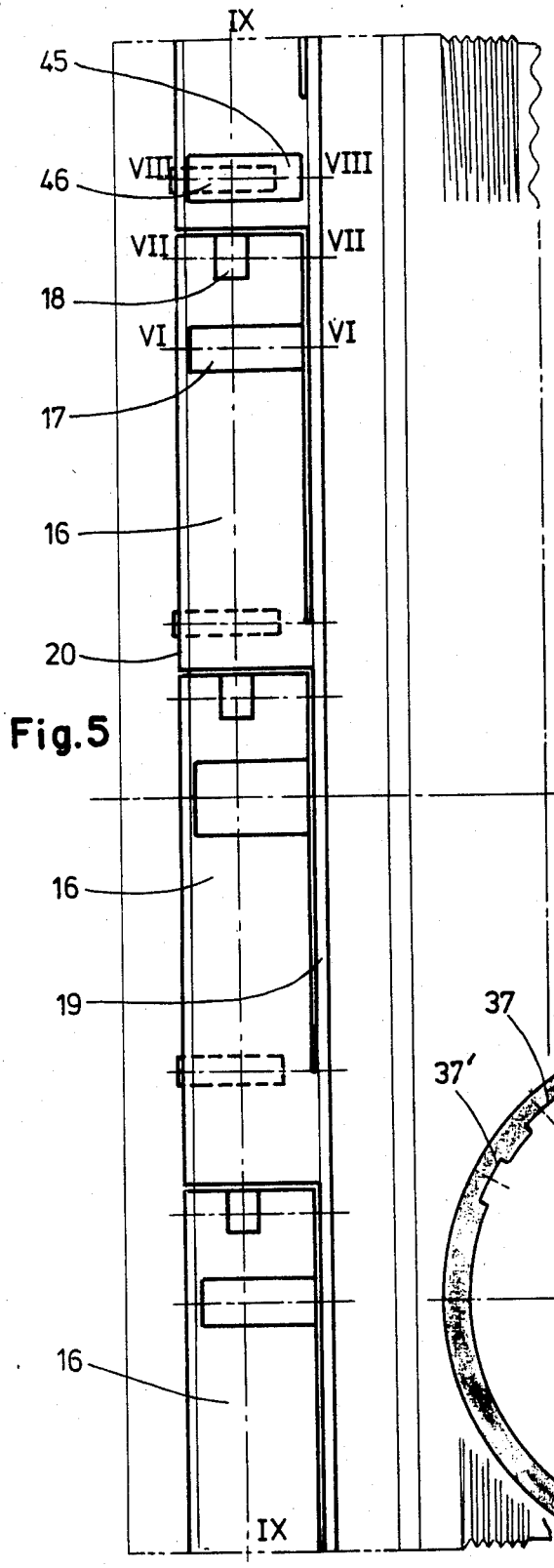
Figure 15:
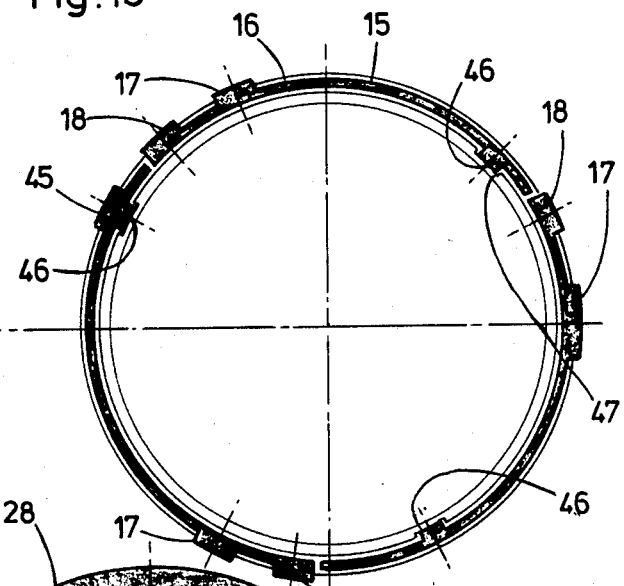
Figure 16:
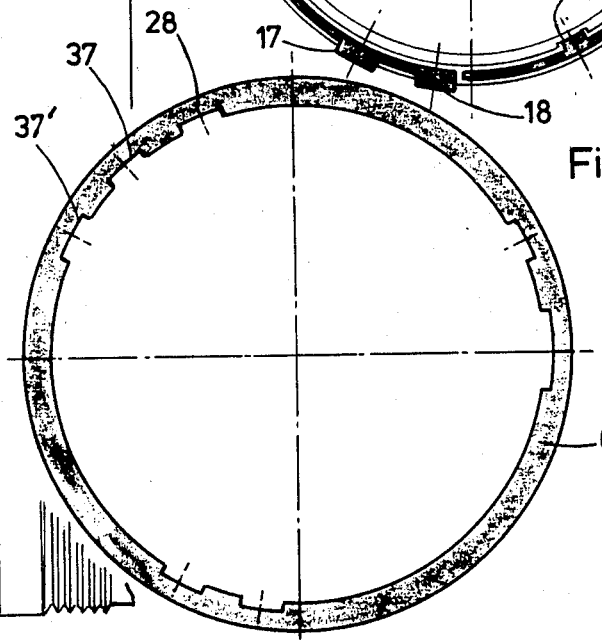
Figure 8:
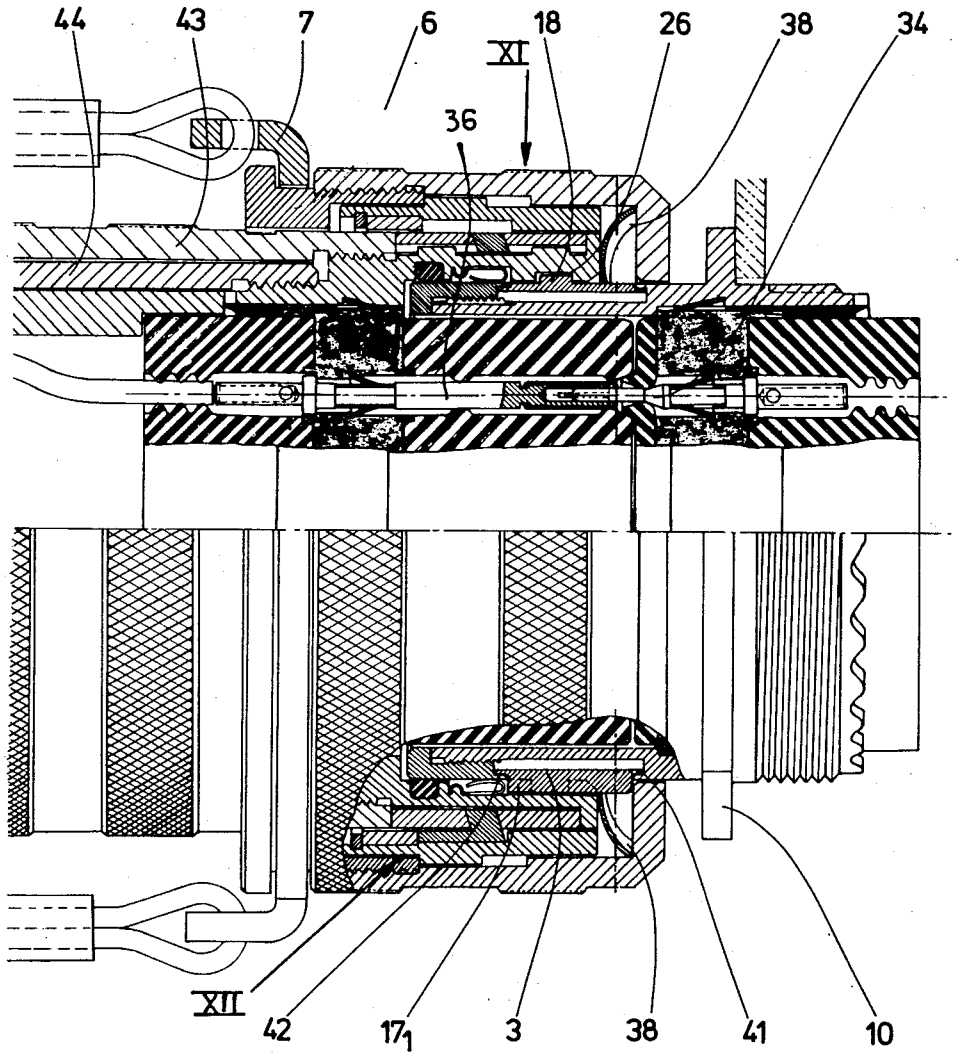
Figure 9:
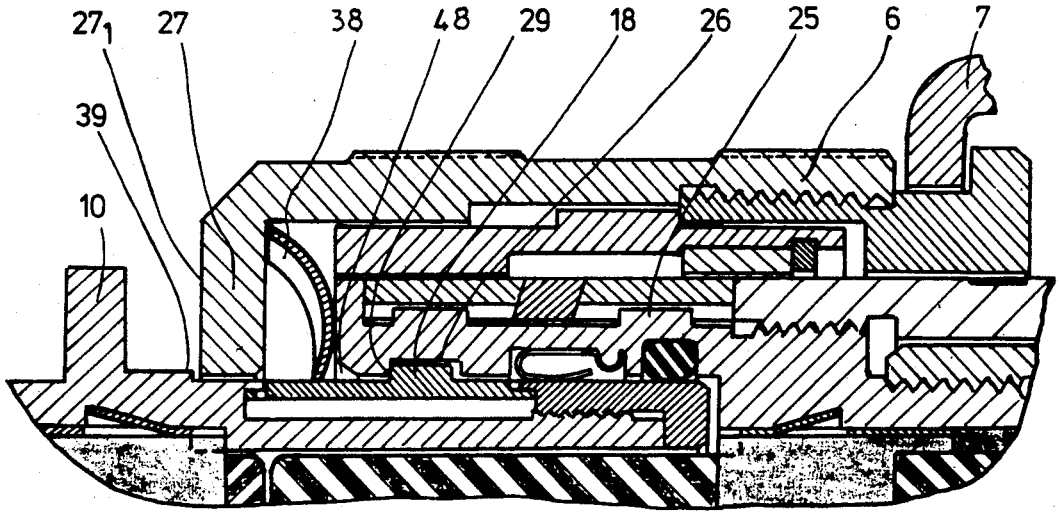
Figure 10:
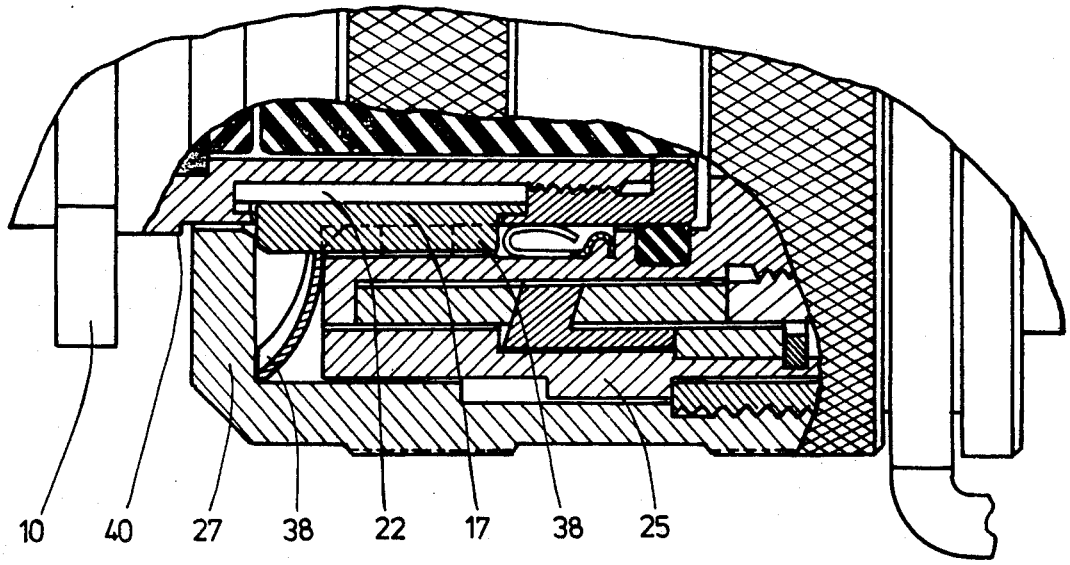
Figure 11:
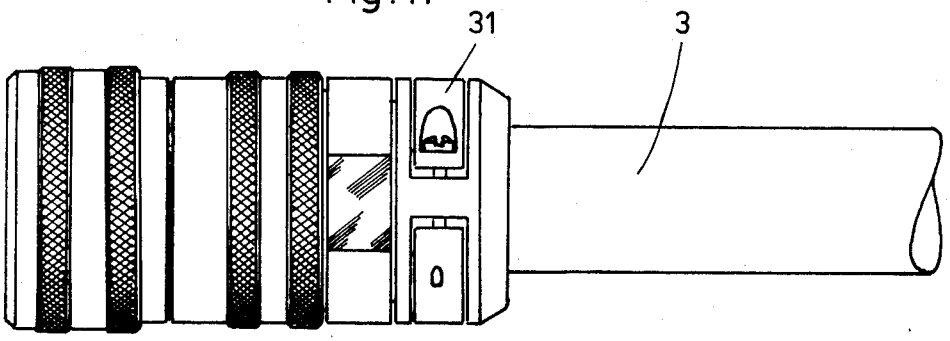
Figure 12:
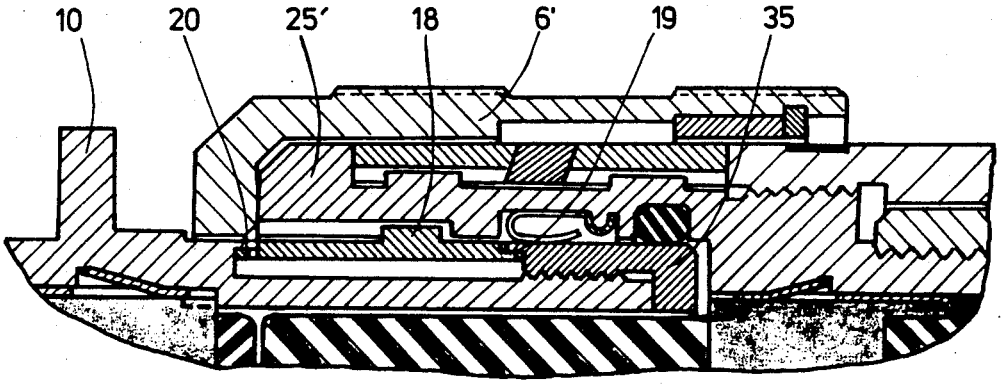
Figure 13:
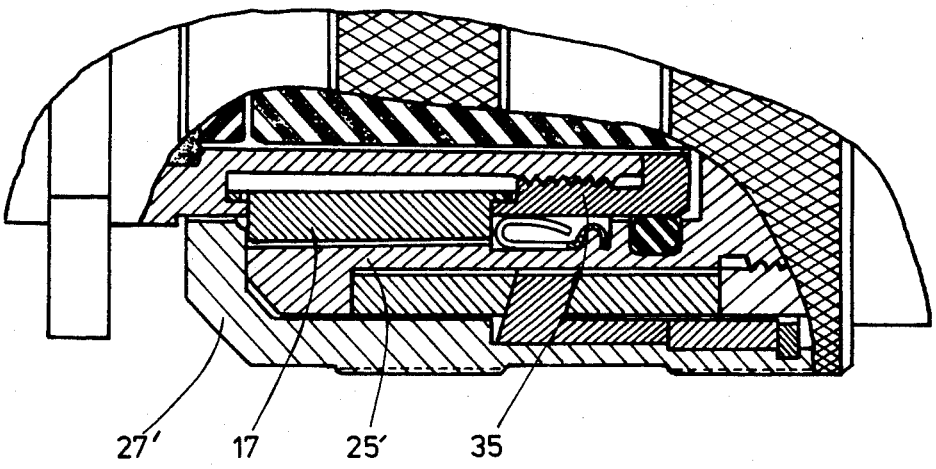

The present invention is described in more detail below with reference to the attached drawings, in which FIG. 1 is a side view of a first embodiment of a connector plug according to the invention, FIG. 2 is a side view of a base for a plug according to FIG. 1, FIG. 3 is a front view of the base of FIG. 2, FIG. 4 is a half view in axial section of the base according to FIGS. 2 and 3, FIG. 5 is a developed view of part of the body of the base, showing the positioning of the guiding and correction elements and locking and releasing elements (this view being the reverse of FIG. 4), FIG. 6 is a sectional view taken on the line VI—VI of FIG. 5, FIG. 7 is a sectional view taken on the line VII—VII of FIG. 5, FIG. 8 is a view partially in section of the whole connector according to the first embodiment FIG. 9 shows detail XI of FIG. 8 on an enlarged scale, FIG. 10 shows detail XII of FIG. 8 on an enlarged scale, FIG. 11 shows a second embodiment of the invention, FIG. 12 is a partial sectional view analogous to that of FIG. 9 but representing the plug of FIG. 11, FIG. 13 is a view analogous to FIG. 10 but representing the plug of FIG. 11, FIG. 14 is a sectional view analogous to that of FIG. 7 showing the third embodiment of the invention, taken on the line VIII—VIII of FIG. 5, FIG. 15 shows the form of the collar 15′ according to the third embodiment of the invention, FIG. 16 is a front view of the bolt according to the third embodiment of the invention.

According to FIG. 1, 2 and 3, a connector is composed of a plug 1 (FIG. 1) and a base 2 (FIGS. 2, 3), these two parts being shown joined together in FIG. 8.

In FIG. 1, the body 4 of the plug 1 is attached to the end of a cable 3 by a locking collar 5 connecting the two parts mechanically and by electric connections not shown in this Figure.

The plug 1 also comprises a bolt 6 for connecting it to the base 2. The bolt has a ring 7 to which are attached two cords 8 for exerting a force on the plug, enabling it to be separated from the base 2 without turning the bolt 6.

According to FIGS. 2 to 8, the base 2 of the connector is composed of a body 9 integral with a plate 10 provided for mounting it and having mounting apertures 11.

The body 9, which is in the form of a sleeve, has a recess 14 designed to receive a locking device 15, and a member 39 attached to the base 9 for mounting and holding in position the locking device 15.

This locking device 15 consists of a collar in which peripheral tongues 16 are cut out, one end of each tongue being attached to the collar while the other end is free.

The free end of each tongue 16 carries a ridge (lug) 17 acting both as guiding and correcting device and as a control lug, and another ridge (lug) 18 forming a device for retaining the plug 1 in position. The control lug 17 is designed to cooperate with the bolt 6, on the one hand to retain the bolt 6 so long as the pull exerted on and by the bolt 6 (cord 8) is below a certain releasing force and on the other hand to yield to the bolt 6 when the pull exerted on the bolt 6 reaches the threshold required for the release. At that moment, the bolt 6 makes the tongue 16 recede by forcing the lug 17 into its seating 14.

The retaining lug 18 is designed to retain the body 25 of the plug 1 in a seating 26. when the lug 17 is forced in by the backward movement of the bolt 6, the lug 18 which is an integral part of the tongue 16 also withdraws, thereby releasing the plug 1.

Although the description given above mentions only one tongue 16, it will be obvious that several such tongues, for example three tongues, are distributed over the periphery of the collar forming the locking device 15.

FIG. 4 taken in conjunction with the FIGS. 5, 6 and 7 shows in more detail the structure of the locking device 15, its recess 14 and the members associated therewith.

Each tongue 16 is cut out of the collar, leaving a band 19 to ensure the peripheral continuity and a band 20 for support.

The collar 15 is held inside the seating 14 by the bands 19 and 20 by means of projections 40 and 41 on the base 9 and the part 39.

Under these conditions, the lugs 17 and 18 can only move downwards into the seating 14. In the normal position, the lugs 17 and 18 project from the surface.

The collar is rotationally fixed on the base 2, for example, as indicated in FIG. 15 of the drawing, by means of ridges 46 on the collar and grooves 47 in the body of the base.

FIGS. 4 and 6 show the particular section through the lug 17 having a ramp or rounded portion 24 opposing a resistance, more or less great, to the backward movement of the bolt 6 under the effect of traction exerted on the cords 8 after the spring 38 has been compressed (FIG. 8).

FIG. 4 also shows the structure of the base 2, in particular the internal part 33 carrying the pins 34.

The partial sectional views of FIG. 8 and the detailed views of FIGS. 9 and 10 show how the connection is established between the plug 1 and the base 2 which, in general terms, may have the structure, for example, of the connector described in French Pat. Nos. 83 02 696 and 83 11 513, in particular to provide the connection between the plug and the base by a rotation of the bolt through a given angle, for example 100°. The various component parts of the connector not directly related to the present invention will not be described in detail.

It will be sufficient to note that the body 4 of the plug ends in front in a piece 25 in the form of a sleeve which has a relatively complex form in axial section, cooperating with the parts seated between this piece 25 and the bolt 6. The only important feature for the purpose of this invention is the fact that this piece 25 has a seating 26 designed to receive the retaining lugs 18 and grip behind them.

The front edge 27 of the bolt 6 has a set of openings corresponding in form and position to the guide elements 17 of the base when the base 2 and the plug 1 are in alignment (locking).

Locking and unlocking of this connector are effected as follows:

The connector is locked by placing the plug 1 on the base 2 in the correct angular position determined by the guide elements 17 and the corresponding openings 28 in the bolt 6.

The plug-bolt complex 1,6 is fitted over the base 2 by the movement of translation until the front surface $27_1$ of the bolt comes into contact with the stop 39 on the base 2.

In this position, the bolt 6 has cleared the lugs 17 while the grooves of the plug begin to engage these lugs 17.

The bolt is then turned through a certain angle, for example, 100°.

The part 25 of the plug 1, which is prevented from rotating by the lugs 17, now executes a movement of translation due to the mechanical connection existing between the plug 1 and the bolt 6, as already described in French Pat. Nos. 83 02 696 and 83 11 513.

During this movement of translation, the ramp 48 (FIG. 9) of the part 25 of the plug comes into contact with the lug 18 and forces it downwards into the seating 14.

When the part 25 of the plug has completed its movement of translation, the lug 18 moves up again in the seating 26 of the part 25, thereby locking this part.

At the same time, the electric pins 36 and 34 are brought into contact.

Unlocking is effected in the desired manner by exerting a pull of suitable magnitude on the bolt 6. The spring 38 is thereby compressed and a pressure is exerted on the lug 17 which is thereby pushed into the seating 14, causing the lug 18 also to be lowered, so that the plug 25 is released. Accidental pull on the cable 3 cannot disconnect the plug from the base 2 since the edge 29 of the seating 26 grips behind the lug 18 which cannot be forced downwards (FIG. 9).

It should be noted that when the lug 18 is moved downwards to allow the passage of the edge of the plug during the operation of locking the part 25, the part 17 still forms a projection in the corresponding groove of the plug. This is achieved, for example, by making the lugs 17 and 18 different in height.

It should be noted that after the procedure of pulling away the plug 1 by traction on the cord 8, the plug 1 remains in the cocked position, that is to say the state in which it existed after the connector had been locked and the grooves 25' of the plug are no longer in alignment with the openings 28 of the bolt.

To make a fresh connection, it necessary to proceed with a realignment.

This is brought about by manually turning the bolt 6 in relation to the plug through a given angle by means of the part 43 attached to the part 25 of the plug 1 and mounted on this part 25 by means of the part 44 (FIG. 8).

FIGS. 11, 12 and 13 show a second embodiment of a plug 31 of a connector according to the invention. This plug 31 is designed to be separated from its base by means of a certain traction exerted on the electric cable 3. The base 2 of this connector is the same as that described above.

As shown in FIGS. 12 and 13, the part 25' (which corresponds to the part 25 of the plug according to FIGS. 1 to 10) does not have any seating, and only the front edge 27' (FIG. 13) of the bolt 6' grips behind the edge 24 of the control lug 17.

In this second embodiment, locking is carried out in the conventional manner of manually rotating the bolt 6'. The guide elements 17 alone remain in contact with the edge 27 of the bolt.

The connector may be disconnected manually by a rotation of the bolt in the opposite sense to the locking sense or by traction on the electric cable 3. This traction must be sufficient to enable the edge 27' of the bolt 6' to pass over the edge 24 of the lug 17 and release the plug 31.

It is to be noted that the base 2 may also hold plugs such as those of the above mentioned Patents without putting the locking device 15 into use.

In a third embodiment according to FIG. 14, 15, 16 the collar has at least one ridge 45 parallel to the members 17 and 18 situated on that part of the collar 15 which has not been split, and bearing against the base of the seating 14. In this embodiment, the bolt 6 comprises, for example, two additional openings 37 and 37' enabling the bolt to pass over the ridges 45. These ridges 45 cooperate with the members 17 during the coupling procedures.

By way of a general remark, it should be noted that the number of guide elements (or correcting elements), the number of control lugs and retaining lugs, the number of pins, etc. may be chosen according to practical considerations, depending in particular on the use to which the connectors are to be put.

Such considerations do not enter into the scope of the present description.

I claim:

1. An electrical connector comprising:

a plug (1) having a generally cylindrical body open at one end and containing an insert of insulating material provided with pins for electrical connection;

a base (2) having a generally cylindrical body sized to fit coaxially in the open end of the plug and containing an insert of insulating material provided with pins to mate with those of the plug for electrical connection, the base having an exterior annular recess;

a coupling ring (6) mounted around the exterior of the plug body's open end, by means enabling the plug to undergo controlled relative displacement in the axial direction and in rotation, the coupling rign having an edge (27) extending radially inwardly at one end; and a locking device disposed in the recess of the base and having a plurality of control elements (17) normally projecting beyond the diameter of the base's body such that when the plug and base are joined together, at least one control element engages the coupling ring edge to retain the coupling ring on the body of the base, the locking device being capable of withdrawing into the recess of the base under the action of an axially opening force of the connector, which force is transmitted to the coupling ring and exceeds a predetermined threshold.

2. Connector according to claim 1, characterised in that the plug (31) has a part (25') designed to cooperate with retaining elements on the base, the retaining elements (18) acting as guiding and correcting means, separation of the plug and base being controlled solely by the control elements (17).

3. A connector according to claim 1, characterized in that the locking device is formed by a collar having elastic tongues cut therein, the collar being seated in the recess of the body of the base, each tongue having at least one control element (17) protruding beyond the body of the base, the control element cooperating in a locking action with the edge (27) of the coupling ring (6), the depth of the recess being such that the tongues and their protruding control elements withdraw elastically in a locking action into the recess.

4. Connector according to claim 3, characterised in that each tongue (16) is cut out of the collar (15) at least for the greater part of the length of the tongue, so as to leave a connecting band (19) ensuring the continuity of the collar and a supporting band (20), these two bands serving to support the collar under corresponding shoulder (40,41) bordering the sides of the recess (14).

5. Connector according to claim 3, characterised in that the plug (31) has a part (25') designed to cooperate with retaining elements on the base, the retaining elements (18) acting as guiding and correcting means, separation of the plug and base being controlled solely by the control elements (17).

6. Connector according to claim 3, characterised in that each tongue (16) is provided with a control element (17) and a retaining element (18), the control element (17) ensuring that the bolt (6) will be retained so long as the force exerted on the bolt in the direction of pulling it out is below a given threshold, said retaining element (18) cooperating with a part (25) of the plug (1) to ensure that said part will be retained, and, in the event of the fixed threshold for pulling the plug away being exceeded, the force exerted on the bolt (6) causes the edge (27) of the bolt to move over the control element (17) to force it inwards, causing the retaining element (18) to withdraw and thus release the plug (1).

7. Connector according to claim 6, characterised in that the part (25) of the plug (1) is a sleeve having a seating (26) corresponding to the retaining element (18) and designed to cooperate with this retaining element (18).

8. Connector according to claim 6, characterised in that the retaining element (18) is provided between that end of the tongue (16) which carries the control element (17) and the base of the tongue (16).

* * * * *